US010888141B1

(12) United States Patent
Goodhue

(10) Patent No.: US 10,888,141 B1
(45) Date of Patent: Jan. 12, 2021

(54) TECHNOLOGY ENABLED ZIPPER

(71) Applicant: John D. Goodhue, Clive, IA (US)

(72) Inventor: John D. Goodhue, Clive, IA (US)

( * ) Notice: Subject to any disclaimer, the term of this patent is extended or adjusted under 35 U.S.C. 154(b) by 212 days.

(21) Appl. No.: 15/729,925

(22) Filed: Oct. 11, 2017

Related U.S. Application Data

(60) Provisional application No. 62/406,807, filed on Oct. 11, 2016.

(51) Int. Cl.
*A44B 19/24* (2006.01)
*G08B 13/06* (2006.01)
*G08B 21/18* (2006.01)

(52) U.S. Cl.
CPC ..... *A44B 19/24* (2013.01); *G08B 13/06* (2013.01); *G08B 21/18* (2013.01)

(58) Field of Classification Search
CPC ..... A44B 19/24; G08B 13/06; G08B 21/18
See application file for complete search history.

(56) References Cited

U.S. PATENT DOCUMENTS

| | | | | |
|---|---|---|---|---|
| 6,563,424 | B1 | 5/2003 | Kaario | |
| 6,801,140 | B2 | 10/2004 | Mäntyjärvi et al. | |
| 8,533,918 | B1 * | 9/2013 | Ketter | A44B 19/301 24/387 |
| 2006/0164280 | A1 * | 7/2006 | Nehls | G08C 17/02 341/176 |
| 2007/0236361 | A1 * | 10/2007 | Farhadian | A41F 1/00 340/687 |
| 2009/0195400 | A1 * | 8/2009 | Oreshkin | A41D 1/002 340/686.1 |
| 2016/0245665 | A1 * | 8/2016 | Logan | G07C 3/00 |
| 2017/0178471 | A1 * | 6/2017 | Levesque | A41D 1/002 |
| 2018/0308327 | A1 * | 10/2018 | Dobbins | G08B 13/06 |

* cited by examiner

*Primary Examiner* — Mohamed Barakat
(74) *Attorney, Agent, or Firm* — Goodhue, Coleman & Owens, P.C.

(57) ABSTRACT

A method includes sensing position of a slide of a zipper using at least one sensor, communicating the position of the slide of the zipper to a computing device, and executing one or more instructions on a processor of the computing device to perform an action based on the position of the slide of the zipper.

7 Claims, 2 Drawing Sheets

TECHNOLOGY ENABLED ZIPPER

RELATED APPLICATION

This application claims priority to U.S. Provisional Application No. 62/406,807, filed Oct. 11, 2016, and entitled "Technology enabled zipper" hereby incorporated by reference in its entirety.

FIELD OF THE INVENTION

The present invention relates to wearable devices. More particularly, but not exclusively, the present invention relates to zippers.

BACKGROUND

Zippers are a common type of fastener. They generally include two flexible strips of metal or plastic with interlocking projections which are closed or opened by pulling a slide along them. Zippers are used for any number of different purposes including to fasten garments, bags, sporting goods, and any number of other items.

Wearable technology is a growing area. Many items of clothing, bags, and other items worn by a user have zippers. What is needed is a way to add technology to zippers so that any number of conventional items may be transformed into smart items with wearable technology.

SUMMARY

Therefore, it is a primary object, feature, or advantage of the present invention to improve over the state of the art.

It is a further object, feature, or advantage of the present invention to provide a zipper with enhanced technology.

It is a still further object, feature, or advantage of the present invention to provide a zipper in which the state of the zipper may be monitored.

Another object, feature, or advantage is to take action in response to the state of a zipper.

Yet another object, feature, or advantage is to allow an existing zipper to be retrofitted to becoming an intelligent zipper.

A still further object, feature, or advantage is to provide an improved zipper with built-in monitoring.

One or more of these and/or other objects, features, or advantages of the present invention will become apparent from the specification and claims that follow. No single embodiment need provide each and every object, feature, or advantage. Different embodiments may have different objects, features, or advantages. Therefore, the present invention is not to be limited to or by an objects, features, or advantages stated herein.

According to one aspect, a method includes sensing position of a slide of a zipper using at least one sensor, communicating the position of the slide of the zipper to a computing device, and executing one or more instructions on a processor of the computing device to perform an action based on the position of the slide of the zipper.

According to another aspect, a zipper includes a first strip with a first plurality of projections, a second strip adjacent to the first strip with a second plurality of projections, a slide operatively connected between the first strip and the second strip whereby moving the slide along the first strip and the second strip provides for interlocking the first plurality of projections with the second plurality of projections or un-interlocking the first plurality of projections with the second plurality of projections, and an electronics package operatively connected to the slide comprising electronics for monitoring state or position of the slide along the first strip and the second strip.

According to another aspect, a system includes a zipper comprising: a first strip with a first plurality of projections; a second strip adjacent to the first strip with a second plurality of projections; a slide operatively connected between the first strip and the second strip whereby moving the slide along the first strip and the second strip provides for interlocking the first plurality of projections with the second plurality of projections or un-interlocking the first plurality of projections with the second plurality of projections; an electronics package operatively connected to the slide comprising electronics for monitoring state or position of the slide along the first strip and the second strip. The system further includes software executing on a computing device wherein the software is configured to receive state or position of the slide from the zipper.

BRIEF DESCRIPTION OF THE DRAWINGS

Illustrated embodiments of the disclosure are described in detail below with reference to the attached drawing figures, which are incorporated by reference herein.

DETAILED DESCRIPTION

Figure 1:
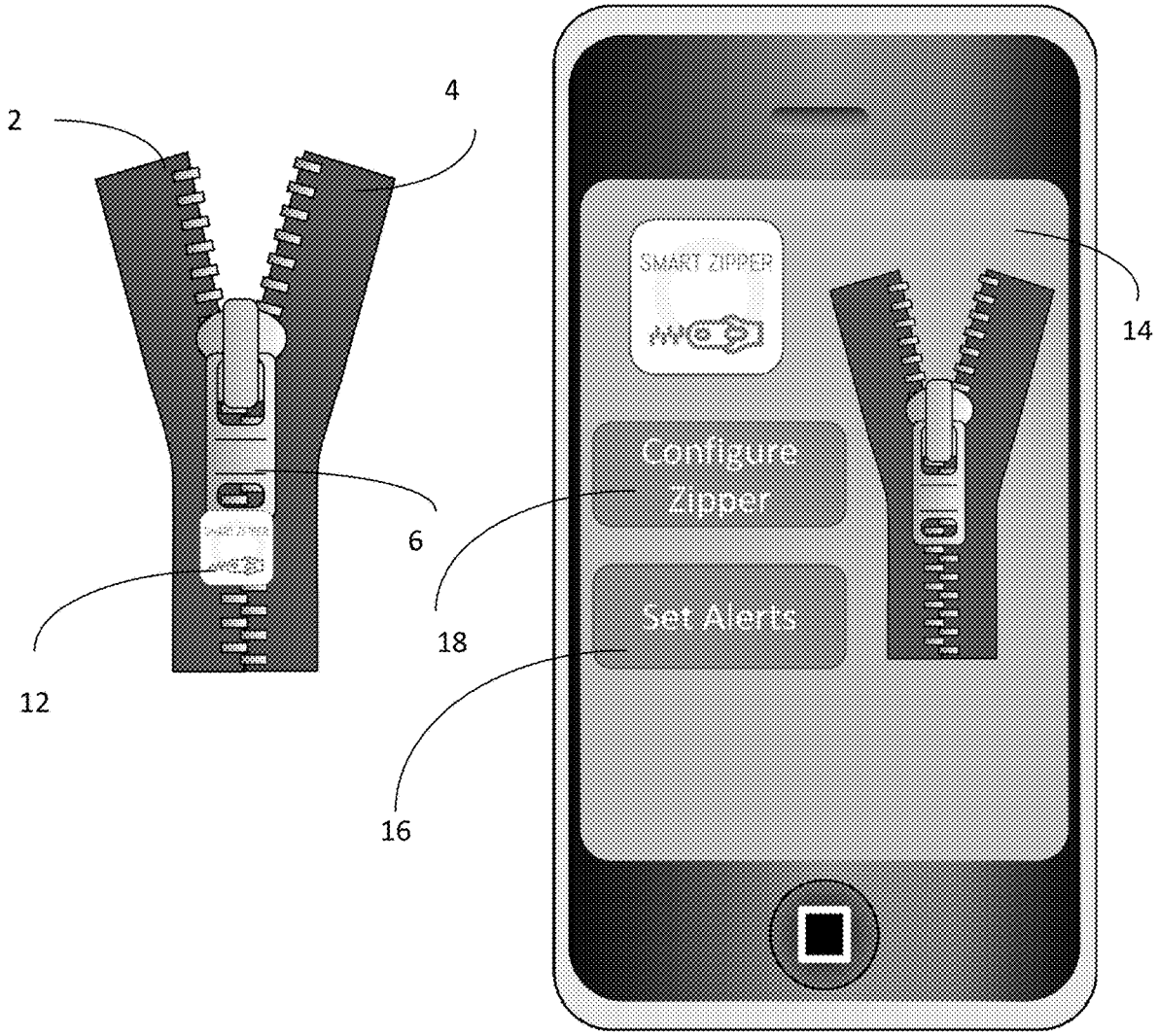
FIG. 1 illustrates one example of a system.

The state of a zipper may be monitored and then communicated to another device. As shown in FIG. 1, a zipper includes a first strip 2 and a second strip 4. A slide 6 of the zipper is used to interlock or un-interlock projections of the first strip and the second strip. An electronics package 12 is operatively connected to the slide 6. This connection may be made in any number of ways including by snap fitting in place, fastening with a cord, fastening with an adhesive, or any number of other methodologies. In some embodiments, the electronics package 12 is retrofitted to an existing zipper. In other embodiments, the electronics package 12 is manufactured as a part of the zipper.

Also shown in FIG. 1 is a mobile device such as a mobile phone with software instructions executing on a processor thereof, such as a mobile app 14. The mobile app 14 includes a user interface which may include functions such as configuring a zipper or setting alerts associated with the zipper state. Of course, any number of other functions may be performed and that which is shown is merely representative.

Figure 2:
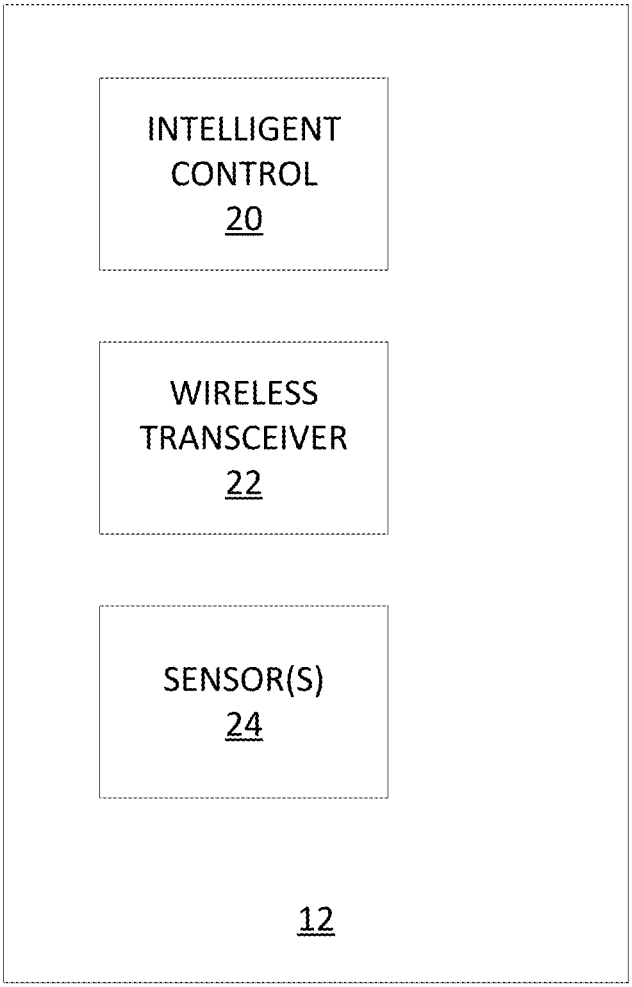
FIG. 2 illustrates one example of a block diagram of an electronics package for a zipper.

FIG. 2 illustrates a block diagram of one embodiment of the zipper's electronics package 12. An intelligent control 20 is shown which may include a processor, microcontroller, or other circuitry or logic for controlling operation of the electronics package. A wireless transceiver 22 is shown which may be a Wi-Fi transceiver, a Bluetooth transceiver, a BLE transceiver, ZigBee transceiver, or other type of transceiver such as may be suitable for IoT applications. One or more sensors 24 are also shown which are used to determine zipper position or zipper state. Each of the electronics components may be electrically connected or otherwise operatively connected with the other electronics components.

Sensing Systems

The present invention contemplates that the state of a zipper may be monitored in any number of ways. For example, for retrofit applications, an inertial sensor may be attached to the slide of the zipper. Thus, as the slide moves up or down the zipper, sensor data indicative of the movement is collected. In one embodiment, each time the slide passes by a projection of the zipper, movement occurs which is detected by the inertial sensor which may be classified appropriately. Thus, an inertial sensor may be used to determine the state of a zipper. For example, the position of the slide relative to either end of the zipper based on the projections that are open or closed. In another embodiment, a first inertial sensor may be associated with the slide and a second inertial sensor may be associated with a stationary portion of the zipper. Sensor measurements between the first inertial sensor and the second inertial sensor may be compared in order to determine which sensor movements are associated with movement of the slide relative to the rest of the zipper. The second inertial sensor may alternatively be positioned elsewhere such as on a belt of a user, embedded into the pants of the user, or otherwise located.

In another embodiment, a specific material may be placed at a particular position along the zipper or one or more projections may be formed from or incorporate the specific material. For example, a magnetic material may be placed at one or both ends of the zipper. A sensor may be placed in or attached to the slide that senses a magnetic field associated with the magnetic material such that position of the zipper may be inferred based on the strength of the magnetic field. In another embodiment, capacitive sensing may be used to determine position of a zipper slide. Capacitive displacement sensors, or capacitive coupling may be used to determine or infer zipper position. Of course, any number of other sensing systems may be used including those that rely on physical properties of the zipper or attachments to the zipper including resistance, capacitance, or other electrical properties. In addition, ultrasonic sensing may be used. Optical sensing may be used, or other types of sensing may be used. For example, different projections may be colored with different colors and an optical sensor may be used within the slide to detect the colors of slide projections as it passes by. In another embodiment audio sensing may be used to detect sounds associated with the zipper. In one implementation, each sound associated with each projection opening or closing may be detected and the status of the zipper may be determined by maintaining a position of the zipper. One or more of the set of projections may also be of differing size or shape in order to provide distinctively different sounds.

An electronics package may be operatively connected to the slide of the zipper. The electronics package may include a power source such as a battery, an intelligent control such as a processor, and a wireless transceiver. Any number of different types of wireless transceivers may be used including Bluetooth, Bluetooth Low Energy (BLE), Wi-Fi, ZigBee, or any number of other types of wireless transceivers. Information sensed with one or more sensors may be interpreted with the processor or other circuitry and conveyed to the wireless transceiver. The electronics package may be implemented on or include a system on a chip (SOC).

Any number of energy harvesting methods may be used in order to provide power for the electronics package. The specific type of energy harvesting method used may depend upon the energy requirements for the electronics package. Examples of energy harvesting may include vibration/motor energy sources, temperature differences, light, RF, or other types of energy harvesting. A battery such as a thin film battery may also be used to store energy which is harvested.

Information regarding the zipper state may be conveyed wirelessly to a remote device. For example, information regarding the zipper state may be conveyed wirelessly to a computing device such as a wearable device such as a smart watch or a mobile phone. Software on the computing device may be used to perform a number of different purposes. This may include executable software instructions for calibration purposes, software instructions for generating an alert or taking other action when a particular state is identified, or executable software instructions for storing occurrences of particular states.

Use Case—Pants Zipper

In one use case, the zipper may be used on a pair of pants and zipper status may be used to assist in monitoring frequency of urination. In particular, each time the zipper state indicates that the zipper is open, an app associated with a watch or phone or other mobile computing device may receive such a notification from the zipper and prompt the user to indicate whether this particular zipper state is associated with a urination event. Thus, this allows for more accurate information to be collected and reminds or otherwise encourages the user to take the appropriate steps.

Use Case—Iffy Zipper

In this use case, a person may retrofit the zipper electronics to an existing article of clothing such as an existing pair of pants, dress, or other item. State of the zipper may be communicated from an electronics package connected to the slide of the zipper to a watch, mobile device or other wearable or computing device. For example, if the zipper becomes unzipped, the person may be notified on their watch so they can take appropriate action to adjust their zipper.

Use Case—Security of Zippered Item

In this use case, an item such as handbag or purse may include a zipper with appropriate electronics. State of the zipper may be communicated from an electronics package connected to the slide of the zipper to a watch, mobile device or other wearable computing device. For example, if the zipper becomes unzipped (such as if a pickpocket is attempting to remove a wallet from the handbag), the person may be notified on their watch or mobile device so they can take appropriate action. In addition, it is contemplated that the electronics package may also be used to detect proximity of the zipper or loss of connection of the zipper.

The invention is not to be limited to the particular embodiments described herein. In particular, the invention contemplates numerous variations in the application for the zipper, the sensing technologies used, whether the zipper is retrofitted or custom manufactured, the type of devices in operative communication with the zipper, and other options, variations, and alternatives. The foregoing description has been presented for purposes of illustration and description. It is not intended to be an exhaustive list or limit any of the invention to the precise forms disclosed. It is contemplated that other alternatives or exemplary aspects are considered included in the invention. The description is merely examples of embodiments, processes or methods of the invention. It is understood that any other modifications, substitutions, and/or additions can be made, which are within the intended spirit and scope of the invention.

What is claimed is:

1. A method comprising:

retrofitting a zipper by attaching an electronics package to a slide of the zipper, the electronics package housing a sensor and wherein the sensor provides for audio sensing, the zipper having a first strip and a second strip and wherein the slide of the zipper is used to interlock or un-interlock projections of the first strip and the second strip to close or open the zipper;

calibrating a software application executing on a processor of a computing device to the zipper;

sensing position of the slide of the zipper using the sensor of the electronics package attached to the slide of the zipper by detecting each sound associated with each projection interlocking or un-interlocking as the slide of the zipper is moved along the first strip and the second strip;

communicating the position of the slide of the zipper from the electronics package to the computing device;

executing one or more instructions of the software application on the processor of the computing device to perform an action based on the position of the slide of the zipper.

2. The method of claim 1 wherein the communicating is wirelessly communicating.

3. The method of claim 1 wherein the action comprises at least one of storing the position of the slide of the zipper within a memory of the computing device, notifying a user of the position of the slide of the zipper, and notifying a user of a state associated with the position of the slide of the zipper.

4. The method of claim 1 wherein the electronics package further comprises an intelligent control and a wireless transceiver operatively connected to the intelligent control, the sensor operatively connected to the intelligent control.

5. The method of claim 4 wherein the communicating is wirelessly communicating using the wireless transceiver.

6. The method of claim 1 wherein the zipper comprises a plurality of projections and wherein sensor data from the sensor is indicative of a number of the projections which are open or closed.

7. A method comprising:

retrofitting a zipper by attaching an electronics package to a slide of the zipper, the electronics package housing at least one sensor, the zipper having a first strip and a second strip and wherein the slide of the zipper is used to interlock or un-interlock projections of the first strip and the second strip to close or open the zipper;

calibrating a software application executing on a processor of a computing device to the zipper;

sensing position of the slide of the zipper using the at least one sensor of the electronics package attached to the slide of the zipper by sensing inertial data associated with each interlocking or un-interlocking of projections of the first strip and the second strip as the slide moves along the first strip and the second strip;

wirelessly communicating the position of the slide of the zipper from the electronics package to the computing device using a wireless transceiver within the electronics package;

executing one or more instructions of the software application on the processor of the computing device to perform an action based on the position of the slide of the zipper;

wherein the sensor is an inertial sensor.

* * * * *